US007918516B2

(12) United States Patent
Decker et al.

(10) Patent No.: US 7,918,516 B2
(45) Date of Patent: Apr. 5, 2011

(54) REFRIGERATOR CASE SHELF

(75) Inventors: Daren M. Decker, McGregor, TX (US); Bryan K. Smith, Desoto, TX (US); Jamie Lorzadeh, Katy, TX (US)

(73) Assignee: Hill Phoenix, Inc., Conyers, GA (US)

( * ) Notice: Subject to any disclaimer, the term of this patent is extended or adjusted under 35 U.S.C. 154(b) by 630 days.

(21) Appl. No.: 11/913,721

(22) PCT Filed: May 26, 2005

(86) PCT No.: PCT/US2005/018684

§ 371 (c)(1),
(2), (4) Date: Nov. 6, 2007

(87) PCT Pub. No.: WO2006/127010

PCT Pub. Date: Nov. 30, 2006

(65) Prior Publication Data

US 2010/0077781 A1 Apr. 1, 2010

(51) Int. Cl.
*A47B 57/00* (2006.01)

(52) U.S. Cl. ..... 312/116; 108/108; 312/234.4

(58) Field of Classification Search ..... 312/234.4, 312/404, 408, 351, 116; 108/106–108; 211/90.01, 211/90.02, 94.01, 103
See application file for complete search history.

(56) References Cited

U.S. PATENT DOCUMENTS

| | | | | |
|---|---|---|---|---|
| 735,700 | A | 8/1903 | Bonney | |
| 2,626,472 | A * | 1/1953 | Stingl | 40/650 |
| 2,936,904 | A | 5/1960 | Streater | |
| 3,044,631 | A * | 7/1962 | Greenman et al. | 108/1 |
| 3,082,880 | A | 3/1963 | Mapson | |
| 3,196,812 | A | 7/1965 | Jacques | |
| 3,511,193 | A | 5/1970 | Schild | |
| 3,603,274 | A | 9/1971 | Ferdinand et al. | |
| 4,108,085 | A * | 8/1978 | Shepherd et al. | 108/108 |
| 4,606,280 | A * | 8/1986 | Poulton et al. | 108/97 |
| 5,228,581 | A | 7/1993 | Palladino et al. | |
| 5,452,812 | A * | 9/1995 | Niequist et al. | 211/187 |
| 5,475,987 | A | 12/1995 | McGovern | |
| 5,921,411 | A | 7/1999 | Merl | |
| 5,947,307 | A | 9/1999 | Battaglia et al. | |
| 6,185,951 | B1 | 2/2001 | Lane et al. | |
| 6,189,707 | B1 * | 2/2001 | Meyers et al. | 211/90.04 |
| 6,883,343 | B2 | 4/2005 | Lane et al. | |
| 6,889,514 | B2 | 5/2005 | Lane et al. | |
| 6,889,518 | B2 | 5/2005 | Lane et al. | |
| 6,915,652 | B2 | 7/2005 | Lane et al. | |
| 7,121,104 | B2 | 10/2006 | Howington et al. | |
| 7,216,500 | B2 | 5/2007 | Schwichtenberg et al. | |
| 2007/0221103 | A1 * | 9/2007 | Trausch | 108/108 |

FOREIGN PATENT DOCUMENTS

| | | | |
|---|---|---|---|
| JP | 2000023804 | * | 1/2000 |
| JP | 2005334261 | * | 12/2005 |

OTHER PUBLICATIONS

European Office Action for Application No. 05 763 214.3, dated Mar. 10, 2010, 7 pages.
PCT International Preliminary Examination Report relating to International Application No. PCT/US05/18684, date of completion of this report, Aug. 16, 2006 (6 pgs.).
PCT International Search Report relating to International Application No. PCT/US05/18684, date of mailing of the International Search Report, Sep. 2, 2005 (1 pg.).
PCT Written Opinion of the International Searching Authority relating to International Application No. PCT/US05/18684, date of mailing, Sep. 2, 2005 (4 pgs.).

* cited by examiner

*Primary Examiner* — Janet M Wilkens
(74) *Attorney, Agent, or Firm* — Foley & Lardner LLP

(57) ABSTRACT

A refrigerated case shelf has a main panel comprising a top wall and left and right sidewalls, respectively depending from left and right edges of the top wall and cooperating with the top wall to define left and right channels. At least one transverse brace is secured to the main panel. A left bracket has an insertion portion within the left channel and a right bracket has an insertion portion within the left channel.

14 Claims, 8 Drawing Sheets

REFRIGERATOR CASE SHELF

BACKGROUND OF THE INVENTION

The invention relates to refrigerator cases. More particularly, the invention relates to structural integration of insulated panels in walls of such cases.

Refrigerator cases (generically including freezers) are used in a variety of commercial situations. One key use is for retail display and vending. Many such cases include a closed rear wall and either an open front or a glass door front.

Providing a forced air flow through the compartment of such cases is important for a number of reasons. Maintaining the desired food temperature in view of exposure to room air is an important factor. Moisture transport is another (e.g., to control undesirable condensation). One common forced flow scheme involves a cold air curtain downwardly discharged from a front top area of the compartment a return flow is drawn through an intake at the bottom front of the compartment.

The return flow may be drawn across a cooling heat exchanger (e.g., an evaporator) in a base of the case. The cooled air passes upward through a rear duct at the back of the compartment. The cooled air then passes forward through a top duct at the front of the top duct, the air is turned downward by turning vanes to form the air curtain. The rear and top ducts may respectively be defined between rear and top insulated panels and non-insulated rear and top duct panels along the rear and top of the compartment.

The refrigerator shelves are typically supported by support brackets engaging slots in an associated pair of uprights along the back of the compartment.

SUMMARY OF THE INVENTION

Accordingly, one aspect of the invention involves a refrigerated case shelf having a main panel comprising a top wall and left and right sidewalls, respectively depending from left and right edges of the top wall and cooperating with the top wall to define left and right channels. At least one transverse brace is secured to the main panel. A left bracket has an insertion portion within the left channel and a right bracket has an insertion portion within the right channel.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
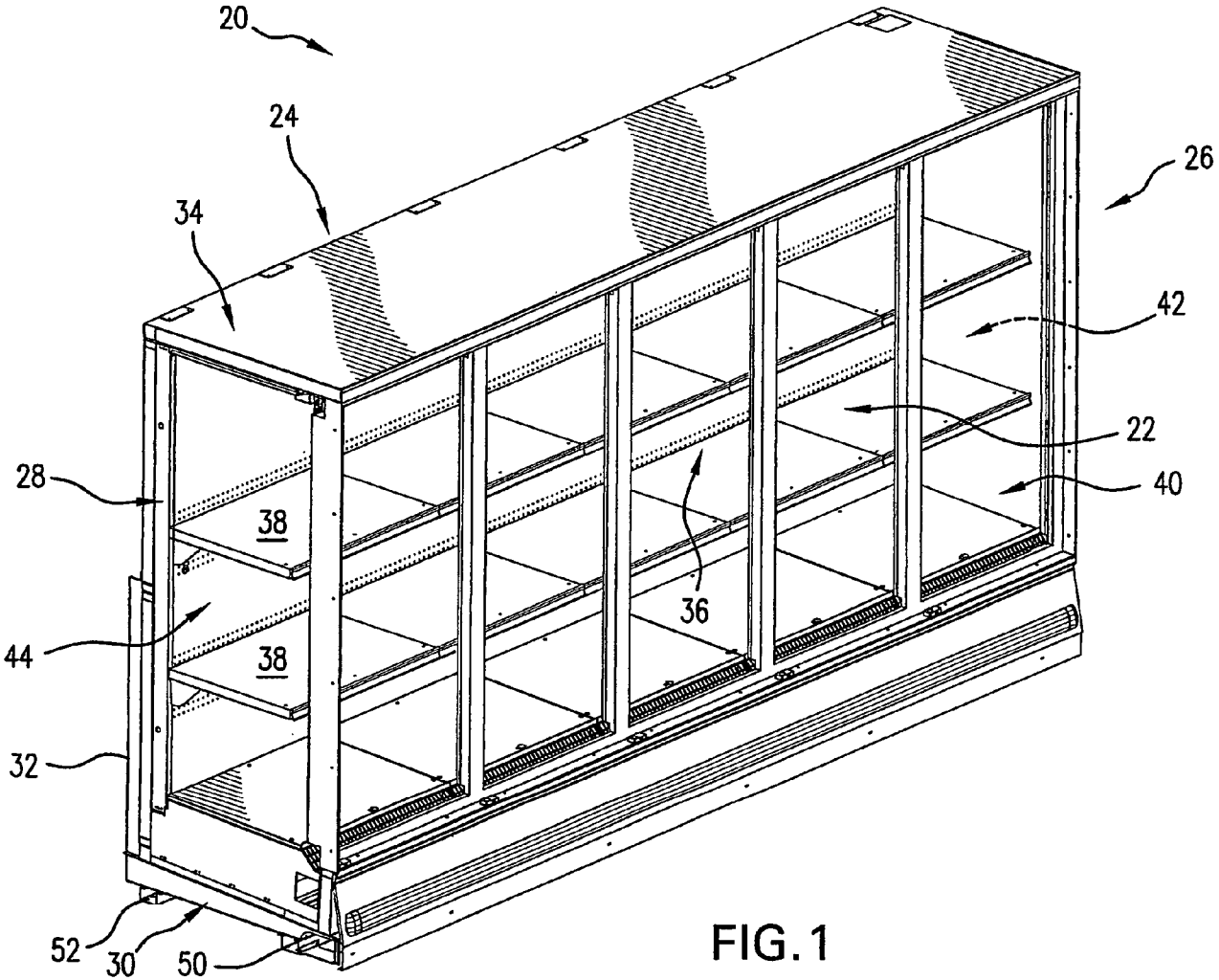
FIG. 1 is a view of a refrigerator case.

FIG. 1 shows a refrigerator case 20 having a front 22, a back 24, and left and right ends 26 and 28. For purposes of reference, front, back, left, and right, are taken from the point of view of the case itself rather than a user facing the case. The case includes a base structure 30, a rear wall structure 32, and a top structure 34. The case has a cooled interior volume or compartment 36. The exemplary case has a series of vertical groups of shelves 38. The exemplary case is a closed case having a sliding or hinged glass door front structure 40 and patch end or partition structures 42 and 44. Partitions are used where cases are arrayed side-by-side; patch ends are used at the two ends of the array. Alternative cases are open-front.

Figure 2:
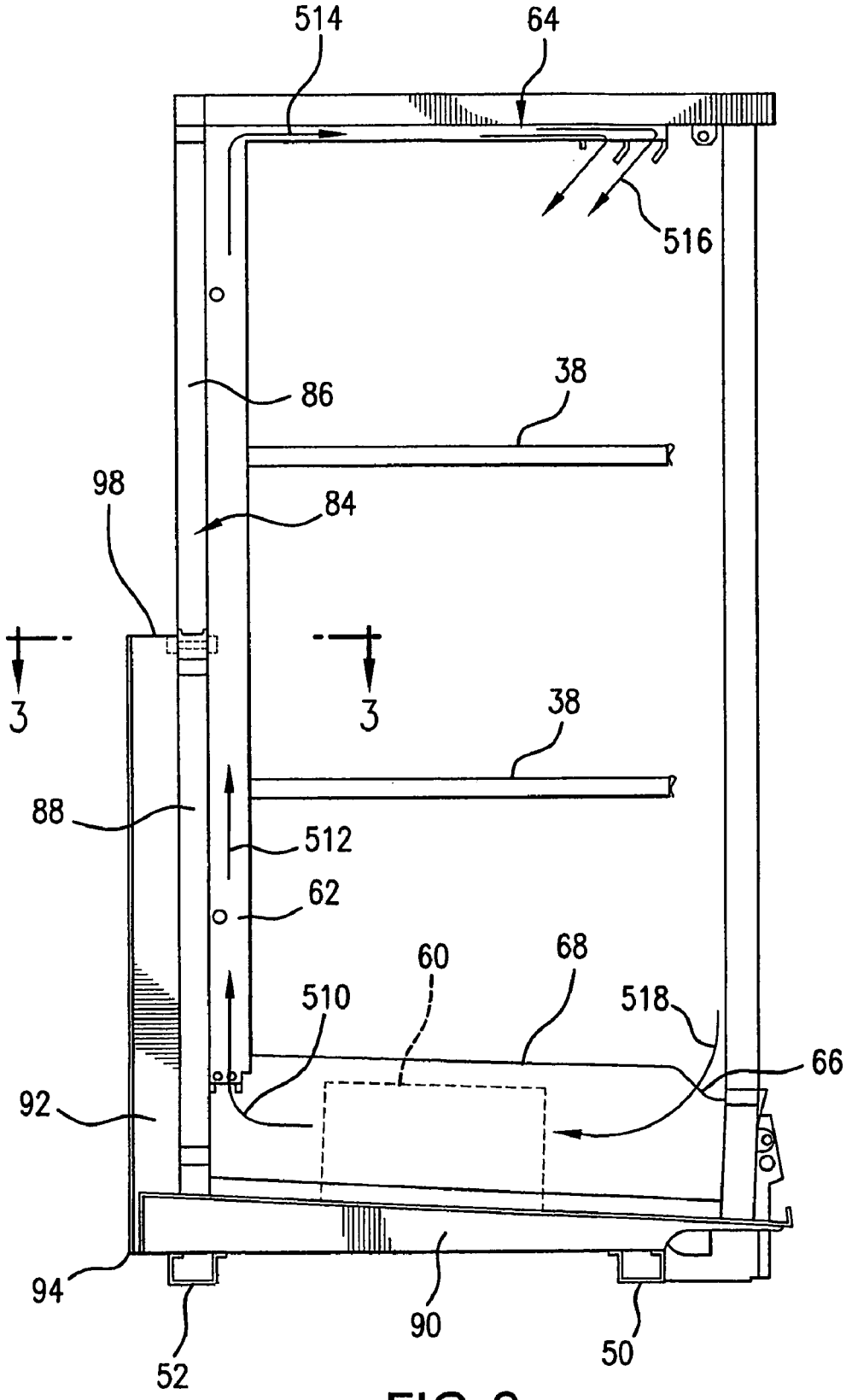
FIG. 2 is a partially schematic side sectional view of the case of FIG. 1.

The exemplary base 30 includes front and back transverse rails 50 and 52 for supporting the remainder of the base and, therethrough, the remainder of the case atop a ground/floor surface. The exemplary base 30 contains the refrigeration equipment (e.g., an evaporator, and the like shown schematically as 60 in FIG. 2). The evaporator may be connected to a central compressor and condenser elsewhere in the facility. Alternatively, the case equipment could be self-contained. FIG. 2 further schematically shows an air flowpath having a first portion 510 carrying cooled air from the equipment 60 to a rear air flowpath section or duct 62. A second portion 512 flows upward through the rear duct 62. A third portion 514 flows forward from the top of rear duct 62 through a top duct 64. A fourth portion 516 exits the top duct near the forward end of the top 34 and is discharged downward along the front 22. A return portion 518 is drawn back into the equipment 60 through a grate 66 near the forward top portion of the base 30 immediately in front of a base cover member 68.

Figure 3:
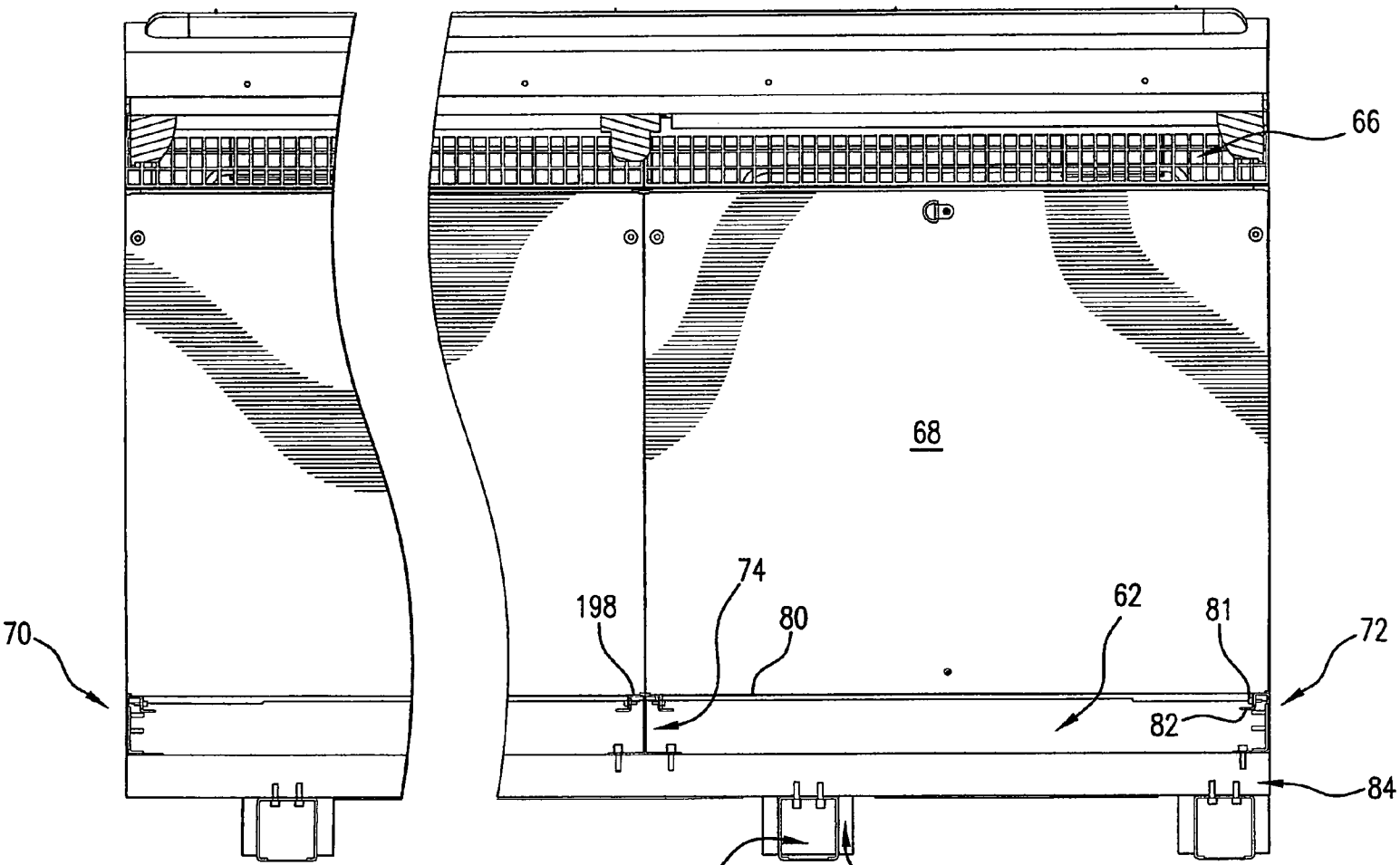
FIG. 3 is a transverse horizontal sectional view of the case of FIG. 2.

FIG. 3 shows further details of the rear duct 62. The duct 62 is segmented by a series of interior uprights including a left upright 70, a right upright 72, and a series of intermediate uprights 74. Forwardly, the duct segments are each bounded by an associated duct panel 80 (e.g., mounted by fasteners 81 to side portions of forward flanges 82 of the adjacent two uprights). As is discussed in further detail below, each shelf 38 may be mounted to these uprights (e.g., a single width shelf spanning and mounted to exactly two adjacent such uprights via mounting apertures in root portions of the flanges 82). Rearwardly, the duct segments are collectively bounded by the forward surfaces of panels of an insulated panel assembly 84. FIG. 2 shows the panel assembly 84 as including an upper panel 86 and a lower panel 88.

FIGS. 2 and 3 further show the base 30 as including a series of support brackets or braces 90 extending front-to-back spanning the rails 50 and 52. Mounted to and extending upward from a rear end portion of each brace 90 is a rear external support 92. Each support 92 has a lower end 94 mounted to the rear end portion 96 of the associated brace 90 and has an upper end 98. As is discussed in further detail below, the panel assembly 84 is sandwiched between the uprights 70, 72, and 74 along the front and the supports 92 along the rear.

Figure 4:
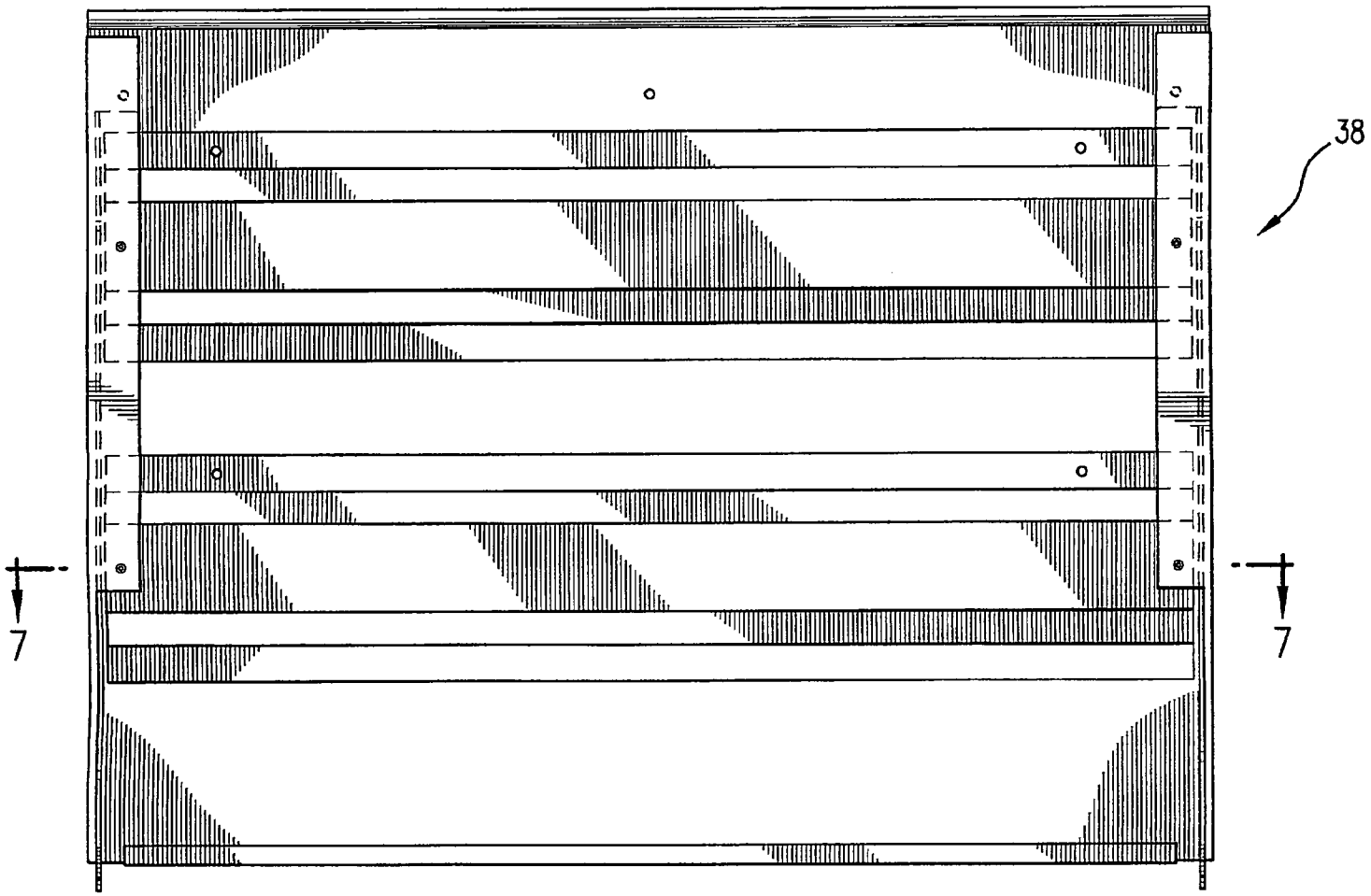
FIG. 4 is a bottom view of a shelf of the case of FIG. 1.
Figure 5:
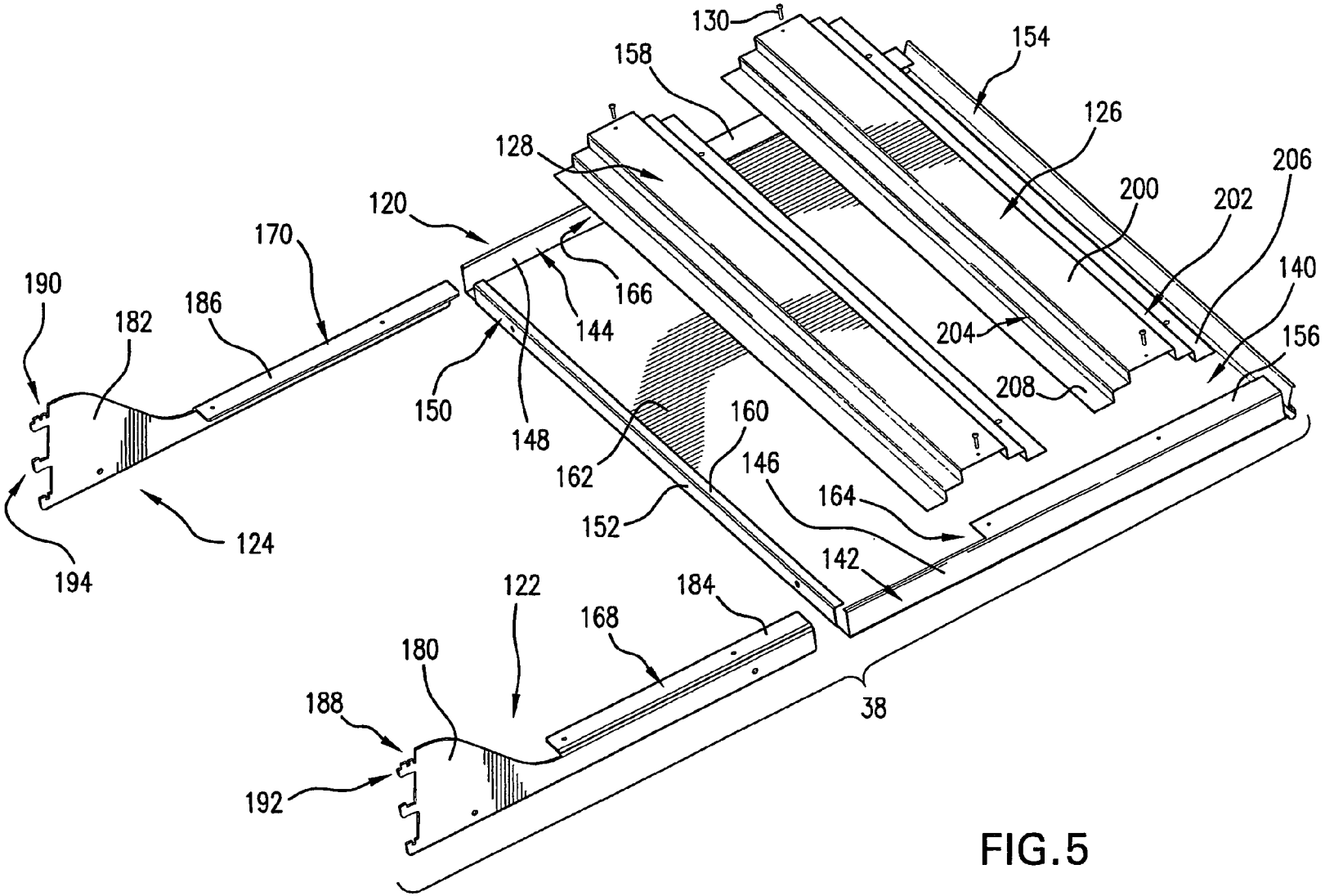
FIG. 5 is an exploded view of the shelf of FIG. 4.

FIG. 4 shows the underside of one of the shelves 38. The exploded view of FIG. 5 shows the shelf as comprising a main panel 120 left and right brackets 122 and 124, and fore and aft transverse braces 126 and 128. Each of these components may be formed of sheet metal (e.g., painted galvanealed steel). The exemplary shelf is held together by fasteners 130 (e.g., stainless steel sheet metal screws).

The exemplary panel 120 includes the unitary combination of a top wall 140, left and right L-sectioned sidewalls 142 and 144 whose legs 146 and 148 respectively depend from left and right edges of the top wall 140, an L-sectioned back wall 150 whose leg 152 depends from a rear/aft edge of the top wall 140, and a convoluted signage carrier 154 at the front edge of the top wall 140. After cutting a panel blank from sheet stock, the signage carrier 154 may be roll formed and the sidewalls 142 and 144 and back wall 150 may be formed by press brake bending.

For structural rigidity, the feet 156, 158, and 160 of the walls 142, 144, and 150 extend inward, generally parallel to the top wall 140. The underside 162 of the top wall 140 cooperates with inboard surfaces of the legs 146 and 148 and upper surfaces of the feet 156 and 158 to create left and right inwardly open channels 164 and 166. The channels 164 and 166 respectively receive forward insertion portions 168 and 170 of the brackets 122 and 124.

Figure 6:
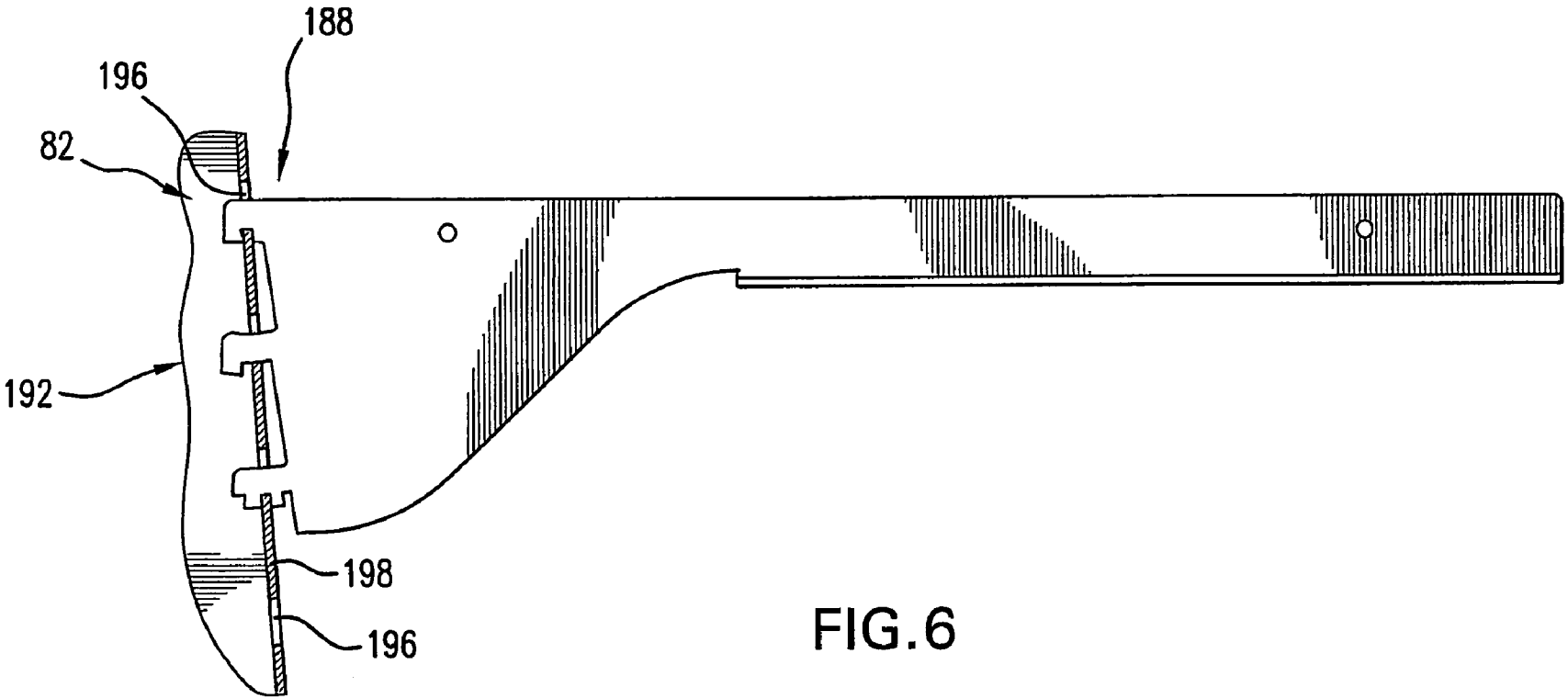
FIG. 6 is a side view of a left bracket of the shelf of FIG. 4.

The insertion portions 168 and 170 are formed by forward portions of vertical webs 180 and 182 and by inwardly extending feet 184 and 186 at lower edges of those forward portions. At rear ends 188 and 190 of the brackets, a series of toothed fingers 192 (see also FIG. 6) and 194 extend rearward for engaging complementary slots 196 (FIG. 6) vertically arrayed in proximal portions 198 of the associated flanges 82 (FIG. 3) of the associated pair of uprights (when the shelf is ultimately installed to the uprights).

The exemplary transverse braces 126 and 128 are identical and extend with essentially uniform cross-section between left and right ends. Each brace includes a central lower web 200 and symmetric fore and aft stepped portions 202 and 204 terminating in fore and aft flanges 206 and 208. Aft relieved areas of the sidewall feet 156 and 158 permit an upward then forward insertion of the braces into the top panel so that the brace end portions fall within the associated channels 164 and 166 and the upper surfaces of the flanges 206 and 208 contact the underside 162. The relieved areas also accommodate depending aft portions of the associated bracket webs 180 and 182 after forward insertion of the respective insertion portions 168 and 170.

Figure 7:
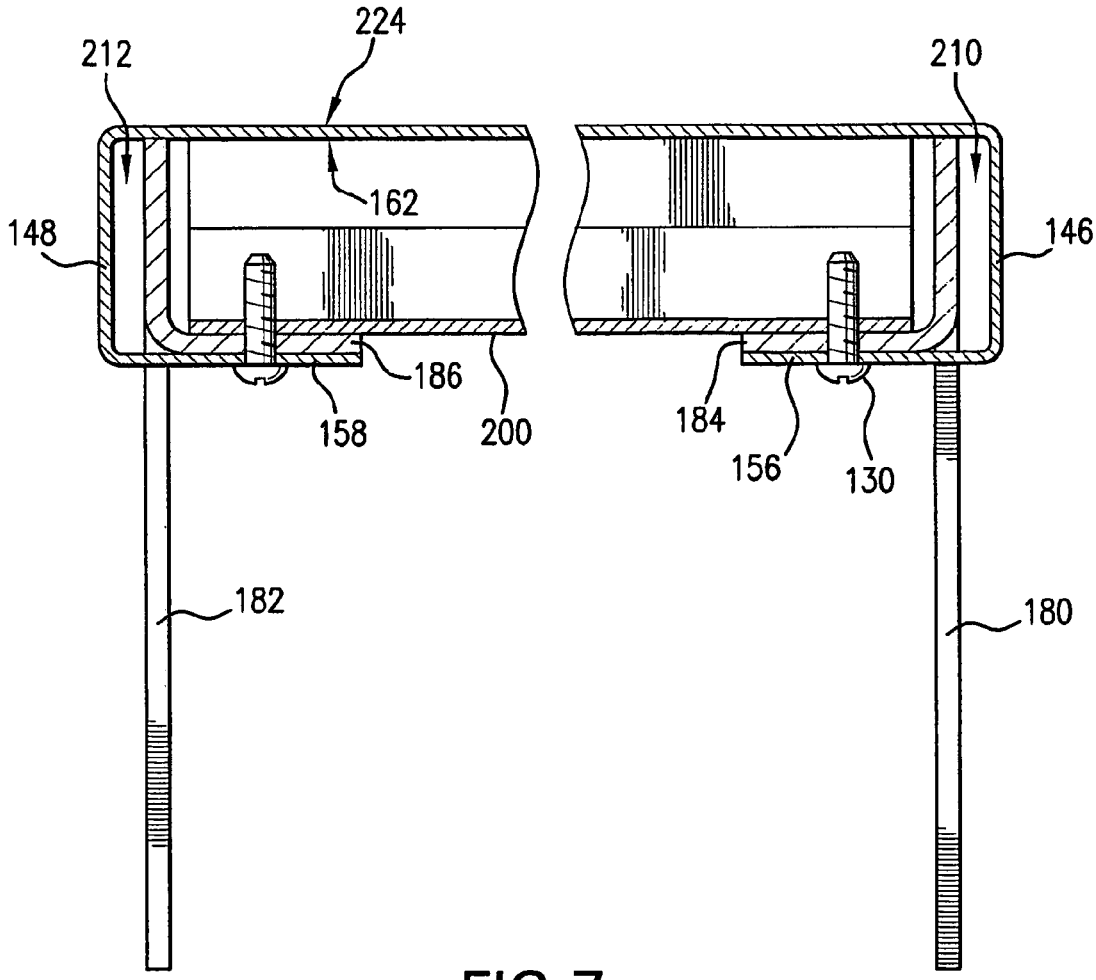
FIG. 7 is a transverse sectional view of the shelf of FIG. 4, taken along line 7-7.

FIG. 7 shows an assembled condition wherein the feet 184 and 186 are captured between the associated sidewall feet 156 and 158 below and the end portions of the brace webs 200 above. The screws 130 extend through these feet and web end portions to secure the shelf components. The bracket webs 180 and 182 are spaced inwardly apart from the adjacent sidewall leg portions 146 and 148 by associated gaps 210 and 212, respectively.

Figure 8:
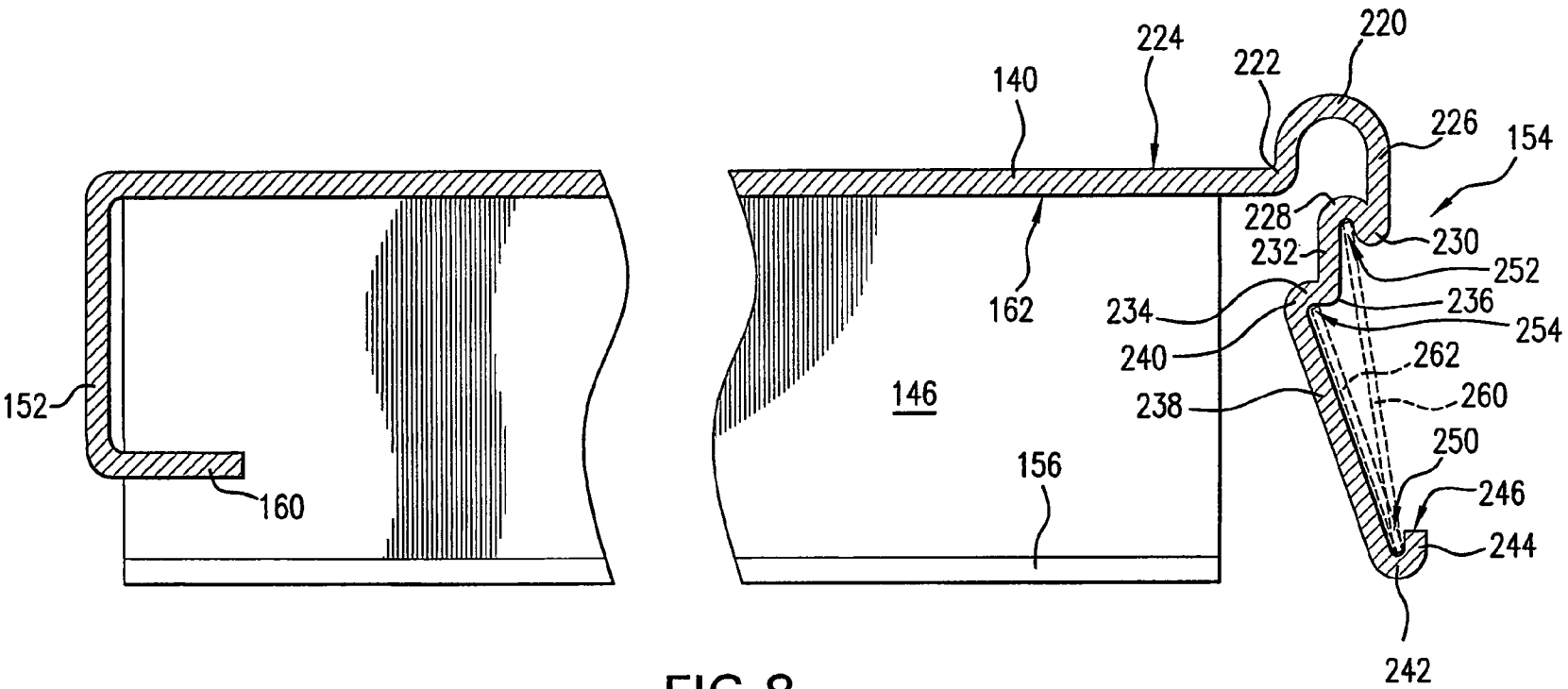
FIG. 8 is a longitudinal sectional view of a top panel of the shelf of FIG. 4.

FIG. 8 shows further details of the signage carrier 154. In section, a downwardly open half-round 220 extends upward from a transition 222 with the forward edge of the top wall 240. The half-round extends above a main upper surface 224 of the top wall 140 to form a proximal retention lip to retain articles on the shelf against sliding forward off the shelf. At the forward end of the half-round 220, a short vertical wall 226 depends. A smaller downwardly open half round 228 extends aft from a transition 230 with the lower end of the wall 226. At the aft end of the half-round 228, a short vertical wall 232 depends. A short horizontal wall 234 extends aft from a transition 236 with the wall 232. A longer wall 238 extends downward and forward from a transition 240 with the wall 234. The carrier terminates in a curved section 242 and upwardly extending short wall 244 ending at a rounded edge 246. This forms an upwardly open distal channel 250 which may cooperate with either of a first downwardly open intermediate channel 252 (formed by the half-round 228) or a second downwardly open intermediate channel 254 (at the transition 240) to retain a signage card 260 or 262.

In various implementations, the shelf 38 may be formed as a drop-in replacement for an existing shelf. The shelf may thus duplicate the overall dimensions of the existing shelf. Exemplary shelf widths are 0.5-1.5 m. Exemplary shelf depths are 0.5-1.5 m.

One or more embodiments of the present invention have been described. Nevertheless, it will be understood that various modifications may be made without departing from the spirit and scope of the invention. For example, the foregoing teachings may be applied in the reengineering of an existing case configuration. In such a reengineering, details of the existing configuration will influence or dictate details of any particular implementation. Accordingly, other embodiments are within the scope of the following claims.

What is claimed is:

1. A refrigerated case shelf comprising:
- a main panel comprising:
  - a top wall; and
  - left and right sidewalls, each having:
    - a leg portion respectively depending from left and right edges of the top wall; and
    - a foot portion extending inward from the associated leg portion, the sidewalls cooperating with the top wall to define left and right channels;
- at least one transverse brace secured to the main panel, the transverse brace having left and right end portions respectively disposed within the left and right channels;
- a left bracket having an insertion portion within the left channel; and
- a right bracket having an insertion portion within the right channel.

2. The refrigerated case shelf of claim 1 wherein the left and right channels are inwardly open.

3. The refrigerated case shelf of claim 1 wherein the left and right end portions are screwed to transversely extending feet portions of the insertion portions of the left and right brackets.

4. The refrigerated case shelf of claim 1 wherein the main panel, left bracket, right bracket, and at least one transverse brace each comprise galvanealed steel.

5. The refrigerated case shelf of claim 1 wherein said left and right brackets are respectively spaced inward of said leg portions of the left and right sidewalls, respectively.

6. The refrigerated case shelf of claim 1 wherein the main panel has a width of 0.5-1.5 m and a depth of 0.5-1.5 m.

7. The refrigerated case shelf of claim 1 wherein the main panel comprises a signage carrier unitarily formed with the top wall.

8. A refrigerated case shelf comprising:
- a main panel comprising:
  - a top wall;
  - left and right sidewalls, unitarily formed with the top wall and respectively depending from left and right edges of the top wall and cooperating with the top wall to define left and right channels; and
  - a signage carrier unitarily formed with the top wall, the signage carrier comprising an upwardly convex lip;
- at least one transverse brace secured to the main panel, the transverse brace having left and right end portions respectively disposed within the left and right channels;
- a left mounting bracket; and
- a right mounting bracket.

9. The refrigerated case shelf of claim 8 wherein the signage carrier comprises a distal upwardly open first channel and an intermediate downwardly open second channel opposite the first channel.

10. The refrigerated case shelf of claim 8 wherein the signage carrier comprises a distal upwardly open first channel and an intermediate downwardly open second channel opposite the first channel.

11. The refrigerated case shelf of claim 10 wherein the signage carrier further comprises a straight wall between the first channel and the second channel and an intermediate downwardly open third channel opposite the first channel and proximally of the second channel.

12. The refrigerated case shelf of claim 8 wherein the signage carrier is roll formed.

13. A refrigerated case shelf comprising:

a main panel comprising:

a top wall; and left and right sidewalls, respectively depending from left and right edges of the top wall and cooperating with the top wall to define left and right channels;

at least one transverse brace secured to the main panel and having left and right end portions respectively within the left and right channels;

a left bracket having an insertion portion within the left channel; and a right bracket having an insertion portion within the right channel;

wherein the left and right end portions are coupled to transversely extending feet portions of the insertion portions of the left and right brackets.

14. A refrigerated case shelf comprising:

a main panel comprising:

a top wall; and a signage carrier unitarily formed with the top wall;

at least one transverse brace secured to the main panel, the transverse brace having a left end portion and a right end portion respectively disposed within a left channel and a right channel;

a left mounting bracket; and a right mounting bracket;

wherein the signage carrier comprises:

an upwardly open first channel;

a downwardly open second channel opposite the first channel;

a straight wall between the first channel and the second channel; and an intermediate downwardly open third channel opposite the first channel and proximate the second channel.

* * * * *